US012250982B1

(12) United States Patent
Zhu

(10) Patent No.: US 12,250,982 B1
(45) Date of Patent: Mar. 18, 2025

(54) FALSE EYELASH TOOL KIT

(71) Applicant: Shanghai Greatcare Trading & Developing Co., Ltd., Shanghai (CN)

(72) Inventor: Changliang Zhu, Shanghai (CN)

( * ) Notice: Subject to any disclaimer, the term of this patent is extended or adjusted under 35 U.S.C. 154(b) by 0 days.

(21) Appl. No.: 18/772,343

(22) Filed: Jul. 15, 2024

(30) Foreign Application Priority Data

Jul. 9, 2024 (CN) ..... 202421621103.5

(51) Int. Cl.
*A41G 5/00* (2006.01)
*A41G 5/02* (2006.01)

(52) U.S. Cl.
CPC ..... *A41G 5/02* (2013.01)

(58) Field of Classification Search
CPC ..... A41G 5/02; A45D 2/48
See application file for complete search history.

(56) References Cited

U.S. PATENT DOCUMENTS

2020/0128896 A1* 4/2020 Bougie ..... A45D 44/00
2020/0390174 A1* 12/2020 Hunter ..... A61Q 1/10
2023/0044141 A1* 2/2023 Hill ..... A41G 5/02

* cited by examiner

*Primary Examiner* — Rachel R Steitz

(57) ABSTRACT

A false eyelash tool kit includes a supporting base and an eyelash clip. The supporting base includes a first magnetic suction element. The supporting base configured to adsorb and support a separated magnetic adsorption false eyelash. The eyelash clip includes a second magnetic suction element, the eyelash clip configured to adsorb the separated magnetic adsorption false eyelash. When the separated magnetic adsorption false eyelashes are adsorbed on the supporting base, a first adsorption force is generated between the separated magnetic adsorption false eyelashes and the supporting base. When the separated magnetic adsorption false eyelashes are adsorbed onto the eyelash clip, a second adsorption force is generated between the separated magnetic adsorption false eyelashes and the eyelash clip; the first adsorption force is less than the second adsorption force.

18 Claims, 5 Drawing Sheets

FALSE EYELASH TOOL KIT

CROSS-REFERENCE TO RELATED APPLICATIONS

The application claims priority of Chinese patent application CN2024216211035, filed on Jul. 9, 2024, which is incorporated herein by reference in its entirety.

TECHNICAL FIELD

The present invention relates to the field of false eyelash tools, in particular to a false eyelash tool kit.

BACKGROUND

As the beauty and cosmetics industry continues to evolve, false eyelashes have become an integral part of many people's daily makeup routine. Among them, separated false eyelashes are very popular, but the existing separated false eyelashes require manual installation of the upper and lower false eyelashes on a special eyelash clip, which is more complicated and time-consuming, and may not achieve a good wearing effect. Therefore, the present invention provides a convenient false eyelash tool for wearing, so that the separated false eyelashes can be automatically attached to the eyelash clip, saving operation time and greatly improving the user experience.

SUMMARY

In order to overcome the shortcomings of the prior art, the present invention provides a false eyelash tool kit, so that the separated false eyelashes can be automatically attached to the eyelash clip, saving operation time and greatly improving the user experience.

The technical solution adopted by the present invention to solve the technical problem is as follows.

The present invention provides a false eyelash tool kit includes:

- a supporting base includes a first magnetic suction element, the supporting base configured to adsorb and support a separated magnetic adsorption false eyelash;
- an eyelash clip includes a second magnetic suction element, the eyelash clip configured to adsorb the separated magnetic adsorption false eyelash;
- wherein when the separated magnetic adsorption false eyelashes are adsorbed on the supporting base, a first adsorption force is generated between the separated magnetic adsorption false eyelashes and the supporting base;
- when the separated magnetic adsorption false eyelashes are adsorbed onto the eyelash clip, a second adsorption force is generated between the separated magnetic adsorption false eyelashes and the eyelash clip; the first adsorption force is less than the second adsorption force.

As an improvement of the present invention, the false eyelash tool further includes the separated magnetic adsorption false eyelash, wherein the separated magnetic adsorption false eyelash includes a first magnetic suction false eyelash and a second magnetic suction false eyelash, each of the first magnetic suction false eyelash and the second magnetic suction false eyelash are provided with a third magnetic suction element.

As an improvement of the present invention, when the first magnetic suction false eyelash is magnetically attached to the second magnetic suction false eyelash, the two third magnetic suction element are magnetically attracted and generate a third adsorption force.

As an improvement of the present invention, the third adsorption force is greater than the second adsorption force.

As an improvement of the present invention, the first magnetic suction false eyelash includes a first false eyelash body a first fixing strip, and the third magnetic suction element, a root of the first false eyelash body is connected and fixed to the first fixing strip, the third magnetic suction element includes a plurality of magnetic suction blocks, and at least two magnetic suction blocks of the plurality of magnetic suction blocks are arranged and fixed to the first fixing strip.

As an improvement of the present invention, the second magnetic suction false eyelash includes a second false eyelash body, a second fixing strip, and the third magnetic suction piece, a root of the second false eyelash body is connected and fixed to the second fixing strip, and at least two magnetic suction blocks of the plurality of magnetic suction blocks are arranged and fixed to the second fixing strip.

As an improvement of the present invention, the first fixing strip is evenly provided with the three magnetic suction blocks of the plurality of magnetic suction blocks, the three magnetic suction blocks are disposed and fixed at two opposite ends and a middle portion of the first fixing strip.

As an improvement of the present invention, the second fixing strip is evenly provided with three magnetic suction blocks, the three magnetic suction blocks are disposed and fixed at two opposite ends and a middle portion of the second fixing strip.

As an improvement of the present invention, the first fixing strip and the second fixing strip are transparent plastic strips.

As an improvement of the present invention, the magnetic suction block is a rectangular magnetic suction block.

As an improvement of the present invention, the supporting base includes a magnetic protrusion, and the first magnetic suction element is located in the magnetic suction protrusion, the magnetic protrusion includes a first magnetic suction surface and a second magnetic suction surface opposite to the first magnetic suction surface, the first magnetic suction surface is configured to adsorb the first magnetic suction false eyelash, and the second magnetic suction surface is configured to adsorb the second magnetic suction false eyelash.

As an improvement of the present invention, the supporting base further includes a supporting platform with a supporting surface, the magnetic suction protrusion is located above the supporting surface, and the supporting surface is configured to support the first magnetic suction false eyelash and the second magnetic suction false eyelash.

As an improvement of the present invention, the magnetic protrusion is arc-shaped approximating a curvature of a eye.

As an improvement of the present invention, a first support gap is provided at a connection part between the support surface and the first magnetic suction surface, the first support gap is configured to accommodate the first magnetic suction false eyelash, a second support gap is disposed at a connection part between the support surface and the second magnetic suction surface, and the second support gap is configured to accommodate the second magnetic suction false eyelash.

As an improvement of the present invention, the first magnetic suction element includes at least two magnetic suction columns located within the magnetic protrusion.

As an improvement of the present invention, upper and lower end surfaces of the magnetic suction column are respectively arranged adjacent to the first magnetic suction surface and the second magnetic suction surface, and a length of the magnetic suction column is less than a width between the first magnetic suction surface and the second magnetic suction surface.

As an improvement of the present invention, three magnetic suction columns are evenly disposed within the magnetic protrusion, an interval of the three magnetic suction columns matches an interval of the three magnetic suction blocks, when the separated magnetic suction false eyelashes are adsorbed on the supporting base, the three magnetic suction blocks are respectively matched with the three magnetic suction columns.

As an improvement of the present invention, the eyelash clip includes a first elastic clip arm and a second elastic clip arm, the first elastic clip arm is rotatably connected to the second elastic clip arm, and the first elastic clip arm and the second elastic clip arm are integrally formed.

As an improvement of the present invention, the second magnetic suction element includes a first magnetic suction strip and a second magnetic suction strip, the first elastic clip arm is connected to a first chuck, the first chuck is attached to the first magnetic suction strip, the second elastic clip arm is connected to a second chuck, the second chuck is attached to the second magnetic suction strip, and the first chuck and the second chuck are arc-shaped and matched with the magnetic suction protrusion.

As an improvement of the present invention, an inner surface of the first elastic clip arm is provided with a limiting groove, an inner surface of the second elastic clip arm is provided with a limiting column, and when the first elastic clip arm rotates to clamp the second elastic clip arm, the limiting column is fixed in the limiting groove.

The present invention has the beneficial effects: The present invention provides a false eyelash tool kit includes including a supporting base. The supporting base includes a first magnetic suction element, the supporting base configured to adsorb and support a separated magnetic adsorption false eyelash. An eyelash clip includes a second magnetic suction element, the eyelash clip configured to adsorb the separated magnetic adsorption false eyelash. When the separated magnetic adsorption false eyelashes are adsorbed on the supporting base, a first adsorption force is generated between the separated magnetic adsorption false eyelashes and the supporting base. When the separated magnetic adsorption false eyelashes are adsorbed onto the eyelash clip, a second adsorption force is generated between the separated magnetic adsorption false eyelashes and the eyelash clip; the first adsorption force is less than the second adsorption force. Through the above structure, upper and lower magnetic adsorption false eyelashes can be respectively adsorbed and fixed on the supporting base with the first magnetic suction element according to specific placements. When user approaches the eyelash clip with a second magnetic suction element, due to the first adsorption force being less than the second adsorption force, the two magnetic suction false eyelashes will quickly separate from the supporting base and adsorb onto the two chucks of the eyelash clip, effectively achieving the automatic installation of the separated false eyelashes on the eyelash clip, solving the difficulty for beginners to install the separated eyelashes on the eyelash clip, saving operation time, making it convenient to wear, and greatly improving the user experience.

BRIEF DESCRIPTION OF THE DRAWINGS

In order to explain the technical solutions of the embodiments of the present invention more clearly, the following will briefly introduce the accompanying drawings used in the embodiments. The drawings in the following description are only some embodiments of the present invention. Those of ordinary skill in the art can obtain other drawings based on these drawings without creative work.

The present invention is further described below in detail in combination with the accompanying drawings and embodiments.

DETAILED DESCRIPTION OF THE EMBODIMENTS

Figure 1:
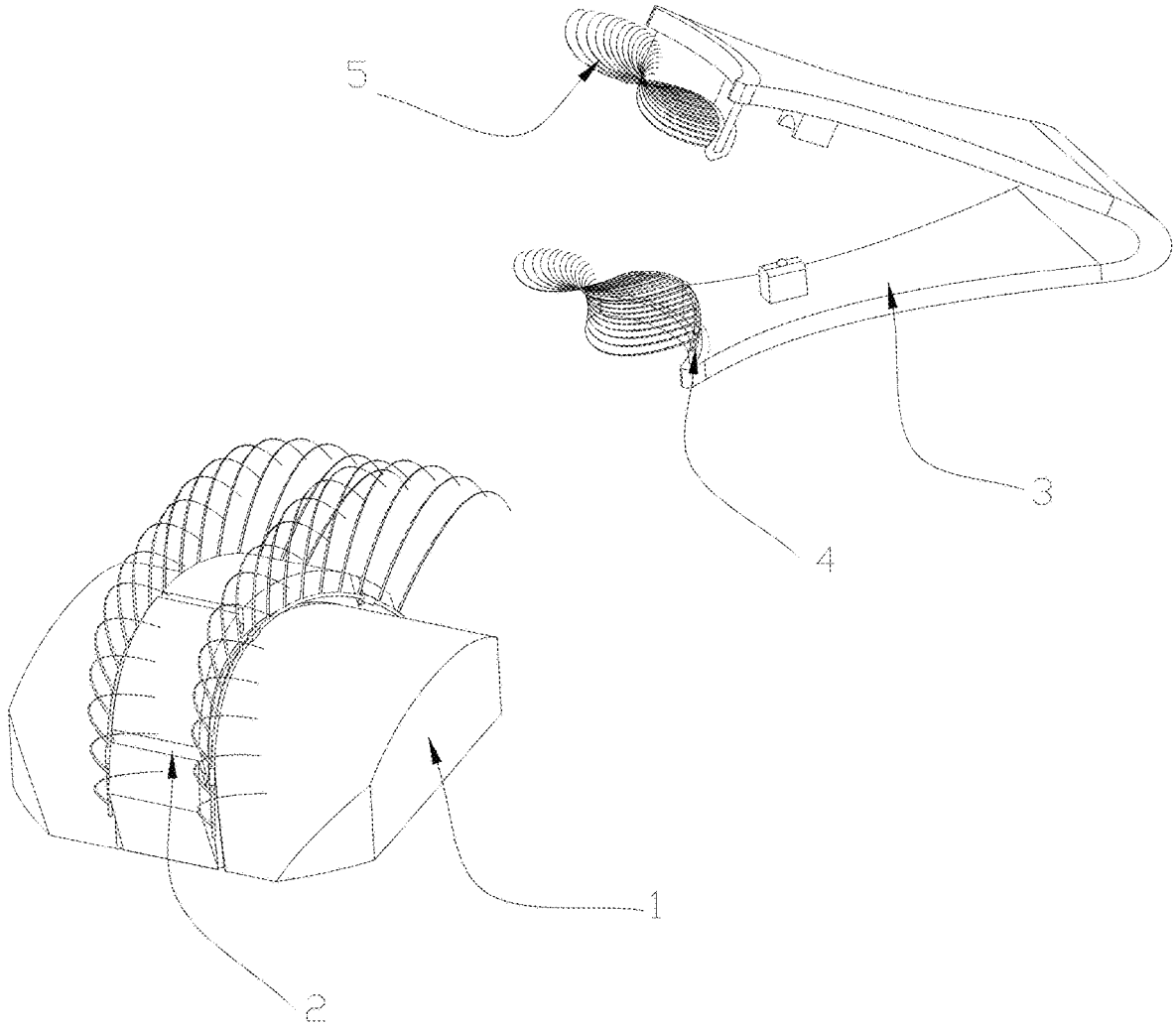
FIG. 1 is a schematic diagram of the structure of the supporting base and eyelash clip of the present invention.
Figure 2:
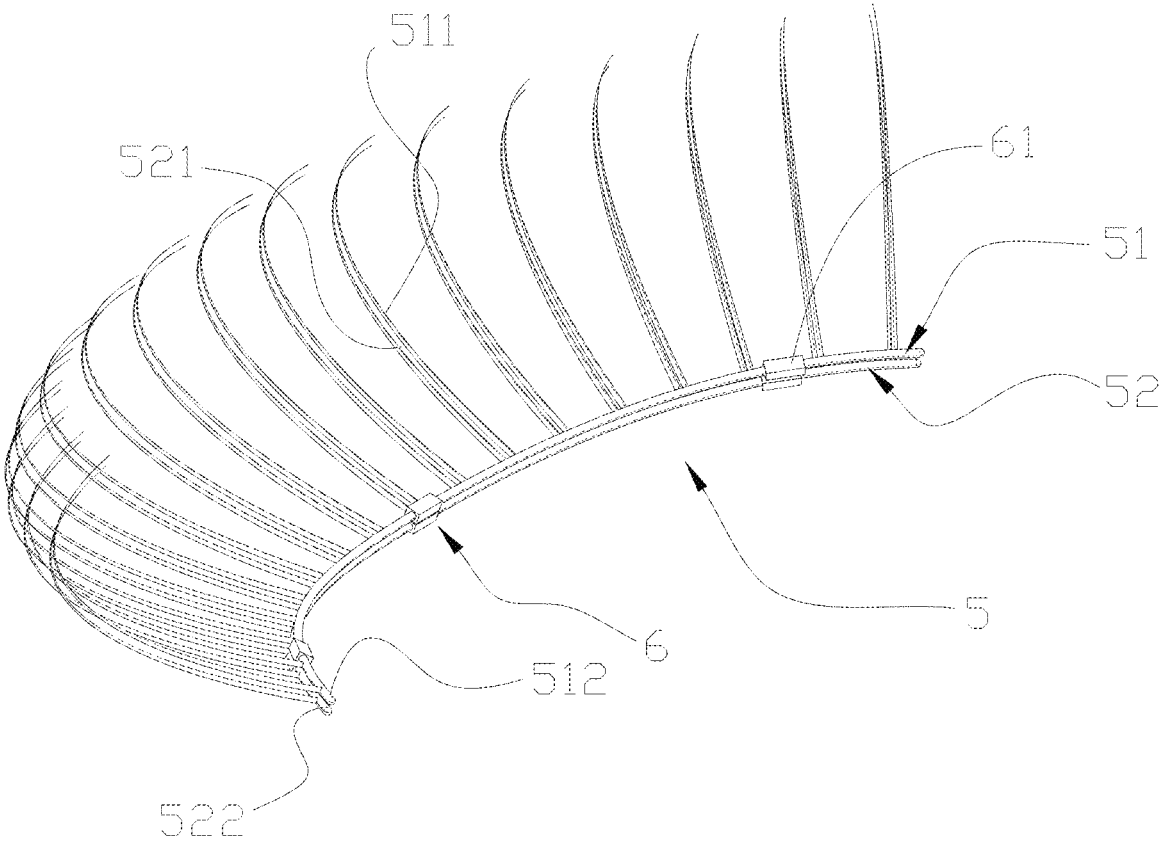
FIG. 2 is a schematic diagram of the structure of the separated magnetic adsorption false eyelash of the present invention.
Figure 3:
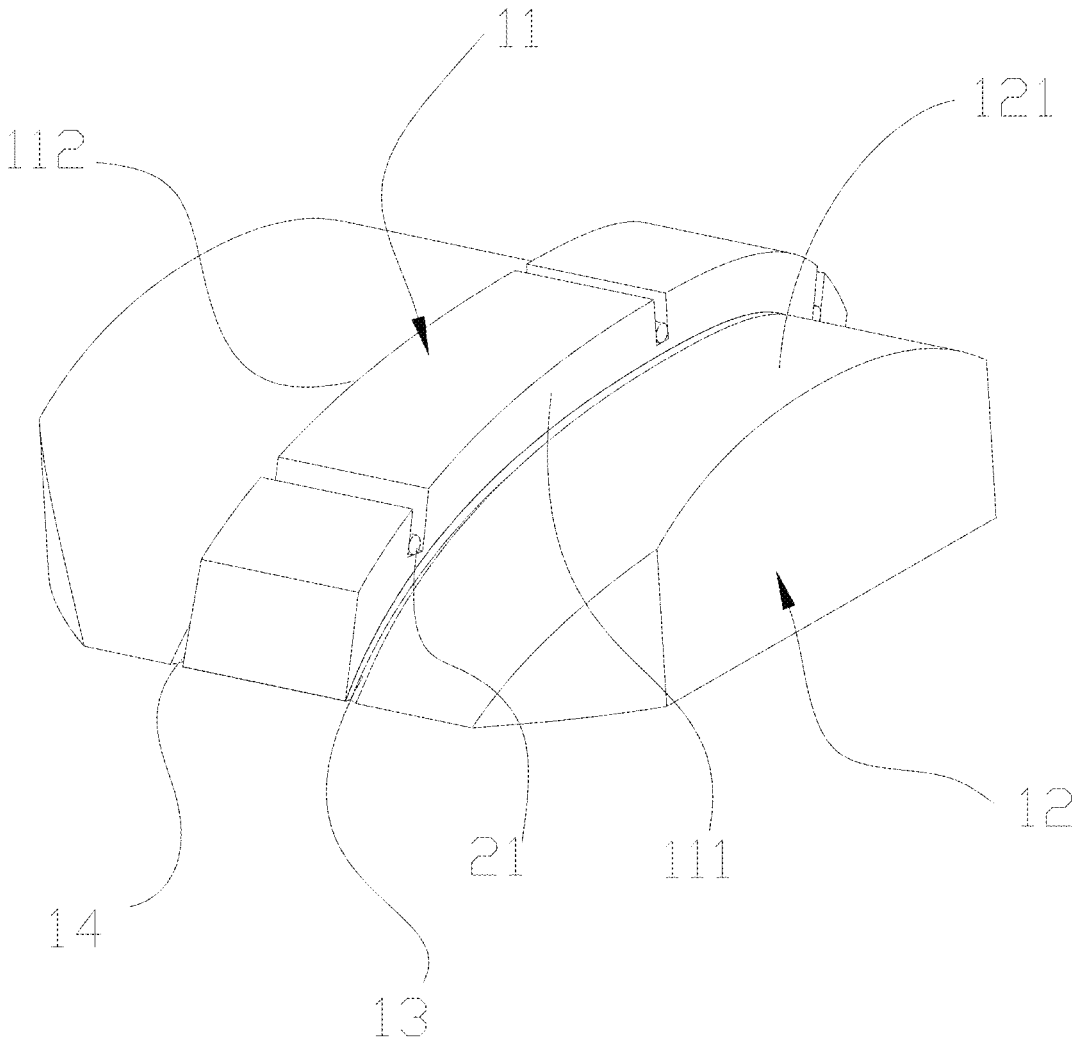
FIG. 3 is a schematic diagram of the structure of the supporting base of the present invention.
Figure 4:
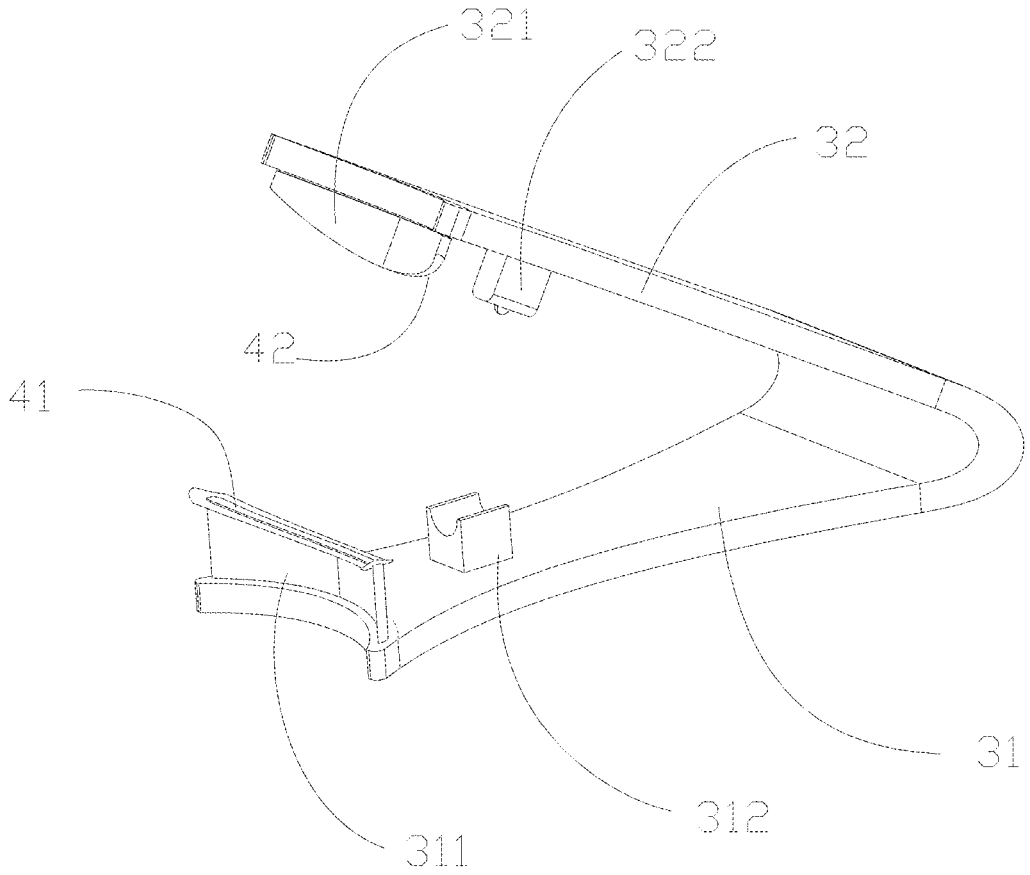
FIG. 4 is a schematic diagram of the structure of the eyelash clip of the present invention.
Figure 5:
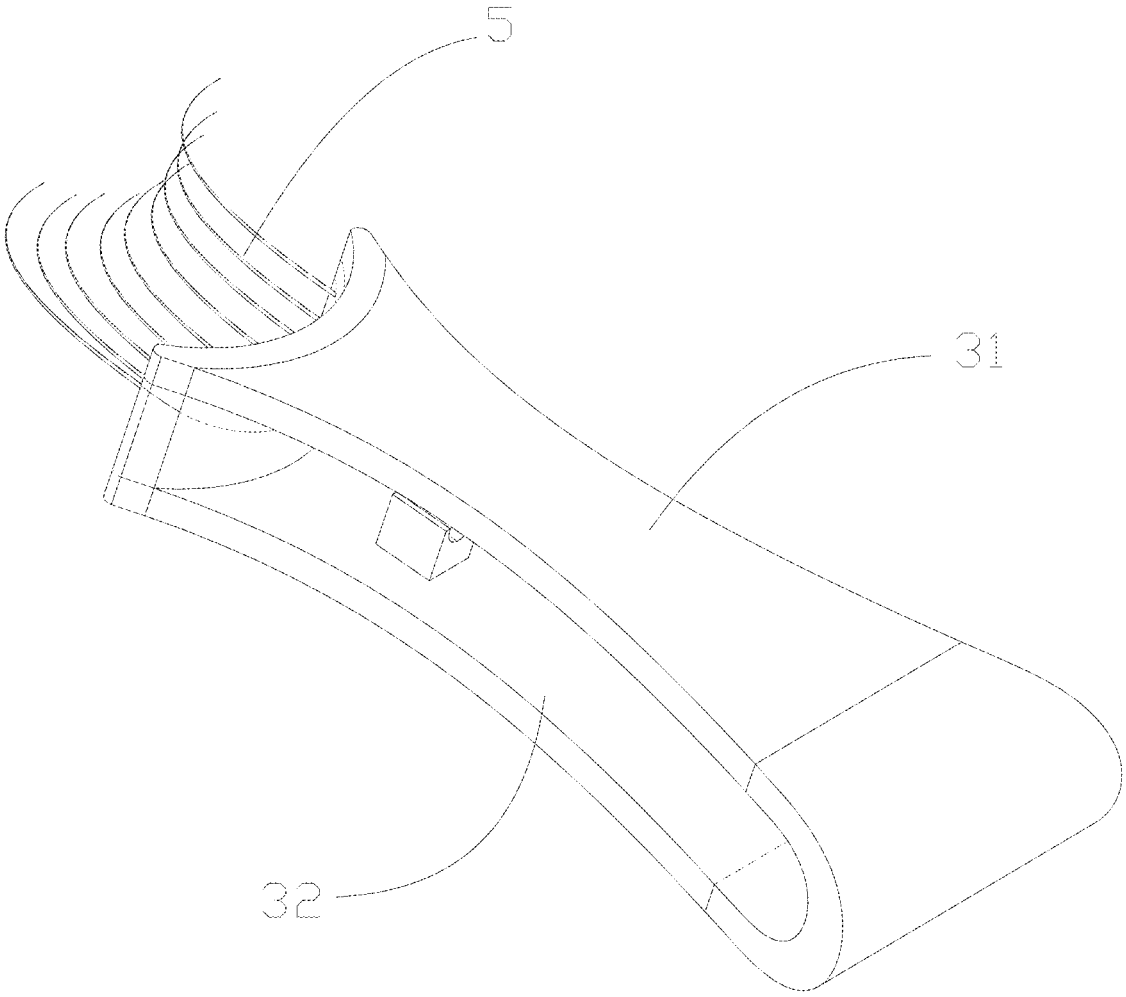
FIG. 5 is a schematic diagram of the use state of the eyelash clip of the present invention.

Referring to FIG. 1 to FIG. 5, a false eyelash tool kit includes a supporting base 1 and an eyelash clip 3. The supporting base 1 includes a first magnetic suction element 2, configured to adsorb and support a separated magnetic adsorption false eyelash 5. The eyelash clip 3 includes a second magnetic suction element 4, configured to adsorb the separated magnetic adsorption false eyelash 5. When the separated magnetic adsorption false eyelash 5 is adsorbed on the supporting base 1, a first adsorption force is generated between the separated magnetic adsorption false eyelash 5 and the supporting base 1. When the separated magnetic adsorption false eyelash 5 is adsorbed on the eyelash clip 3, a second adsorption force is generated between the separated magnetic adsorption false eyelash 5 and the eyelash clip 3. The first adsorption force is less than the second adsorption force.

Through the above structure, upper and lower magnetic adsorption false eyelashes can be respectively adsorbed and fixed on the supporting base 1 with the first magnetic suction element 2 according to specific placements. Under the first adsorption force, the separated magnetic adsorption false eyelash 5 can be firmly adsorbed on the supporting base 1, ensuring the supporting base 1 with the separated magnetic adsorption false eyelashes 5 is less likely to fall off during movement or transportation, facilitating transportation and storage. When user approaches the eyelash clip 3 with the second magnetic suction element 4, due to the first adsorption force being less than the second adsorption force, the two magnetic suction false eyelashes will quickly separate from the supporting base 1 and adsorb onto the two chucks of the eyelash clip 3, effectively achieving the automatic installation of the separated false eyelashes on the eyelash clip 3, solving the difficulty for beginners to install the separated eyelashes on the eyelash clip 3, saving operation time, making it convenient to wear, and greatly improving the user experience.

In this embodiment, the false eyelash tool kit further includes the separated magnetic adsorption false eyelash 5. The separated magnetic adsorption false eyelash 5 is provided with a third magnetic suction element 6. The separated magnetic adsorption false eyelash 5 includes a first magnetic suction false eyelash 51 and a second magnetic suction false eyelash 52, each of the first magnetic suction false eyelash 51 and the second magnetic suction false eyelash 52 are provided with the third magnetic suction element 6. When the first magnetic suction false eyelash 51 is magnetically attached to the second magnetic suction false eyelash 52, the two third magnetic suction elements 6 are magnetically attracted and generate a third adsorption force. The third adsorption force is greater than the second adsorption force. Through the above structure, when the user wears the separated false eyelashes on a user's original eyelashes, the eyelash clip 3 rotates and clamps on the original eyelashes. The first magnetic suction false eyelash 51 and the second magnetic suction false eyelash 52 are respectively adsorbed and clamped on the user's original eyelashes through magnetic suction elements on the false eyelashes. Due to the third adsorption force generated by the first magnetic suction false eyelash 51 and the second magnetic suction false eyelash 52 being greater than the second adsorption force between the separated magnetic adsorption false eyelash 5 and the eyelash clip 3, when the separated false eyelash clip 3 is tightly attached to the original eyelashes, it will automatically separate from the eyelash clip 3, effectively achieving fast wearing of the separated false eyelashes, saving wearing time, convenient to operate, providing beginners with a better experience of wearing separated false eyelashes.

In this embodiment, the first magnetic suction false eyelash 51 includes a first false eyelash body 511, a first fixing strip 512, and the third magnetic suction element 6. A root of the first false eyelash body 511 is connected and fixed to the first fixing strip 512. The third magnetic suction element 6 includes plurality of magnetic suction blocks 61, and at least two magnetic suction blocks 61 of the plurality of magnetic suction blocks 61 are arranged and fixed to the first fixing strip 512. The second magnetic suction false eyelash 52 includes a second false eyelash body 521, a second fixing strip 522, and the third magnetic suction piece 6. A root of the second false eyelash body 521 is connected and fixed to the second fixing strip 522, and at least two magnetic suction blocks 61 of the plurality of magnetic suction blocks 61 are arranged and fixed to the second fixing strip 522.

Specifically, the first fixing strip 512 is evenly provided with the three magnetic suction blocks 61. The three magnetic suction blocks 61 are disposed and fixed at two opposite ends and a middle portion of the first fixing strip 512. The second fixing strip 522 is evenly provided with the three magnetic suction blocks 61, the three magnetic suction blocks 61 are disposed and fixed at two opposite ends and a middle portion of the second fixing strip 522. Through the above structure, due to the distribution of the three magnetic suction blocks 61 on the first fixing strip 512 and the second fixing strip 522, and the three magnetic suction blocks 61 being fixed at two opposite ends and the middle portion respectively, the first magnetic suction false eyelash 51 and the second magnetic suction false eyelash 52 can play a stable adsorption effect whether they are adsorbed on the supporting base 1 or eyelash clip 3, or on the original eyelashes. The three magnetic suction points ensure that the magnetic suction false eyelashes are less likely to fall or curl during the adsorption process, improving the user's wearing accuracy, achieving a good wearing effect.

In this embodiment, the first fixing strip 512 and the second fixing strip 522 are transparent plastic strips, and the magnetic suction block 61 is a rectangular magnetic suction block 61. Through the above structure, the transparent plastic strip is not easily observed in false eyelashes, improving the authenticity and beauty of false eyelashes. The rectangular magnetic suction block 61 improves the stability of magnetic suction. When the two magnetic suction false eyelashes are clamped tightly, the rectangular magnetic suction block 61 can play a role of magnetic suction to a greater extent.

In this embodiment, the supporting base 1 includes a magnetic protrusion 11, and the first magnetic suction element 2 is located in the magnetic suction protrusion 11. The magnetic protrusion 11 includes a first magnetic suction surface 111 and a second magnetic suction surface 112 opposite to the first magnetic suction surface 111. The first magnetic suction surface 111 is configured to adsorb the first magnetic suction false eyelash 51, and the second magnetic suction surface 112 is configured to adsorb the second magnetic suction false eyelash 52.

Further, the supporting base 1 further includes a supporting platform 12 with a supporting surface 121. The magnetic suction protrusion 11 is located above the supporting surface 121, and the supporting surface 121 is configured to support the first magnetic suction false eyelash 51 and the second magnetic suction false eyelash 52. Through the above structure, the first magnetic suction false eyelash 51 is adsorbed to the first magnetic suction surface 111 with the root facing downwards, and the second magnetic suction false eyelash 52 is adsorbed to the second magnetic suction surface 112 with the root facing downwards. With the auxiliary support of the supporting platform 12, the separated eyelashes can be firmly adsorbed and supported on the supporting base 1, ensuring that the supporting base with the separated magnetic suction false eyelash 5 is less likely to fall off during movement or transportation. It also provides a specific position for the eyelash clip 3 to adsorb and hold the separated eyelashes, which is convenient for adsorption and saves operation time.

In this embodiment, the magnetic protrusion 11 is arc-shaped approximating a curvature of an eye. Through the above structure, as the magnetic protrusion 11 is arc-shaped approximating the curvature of an eye, it can be consistent with the curvature of the eyelash clip 3. The chuck curvature of the eyelash clip 3 can adapt to the curvature of the magnetic protrusion 11, which conforms to the curvature of human eyelashes, improving the simplicity and beauty of wearing eyelashes.

In this embodiment, a first support gap 13 is disposed at a connection part between the support surface 121 and the first magnetic suction surface 111. The first support gap 13 is configured to accommodate the first magnetic suction false eyelash 51. A second support gap 14 is disposed at a connection part between the support surface 121 and the second magnetic suction surface 112, and the second support gap 14 is configured to accommodate the second magnetic suction false eyelash 52. Through the above structure, as the supporting platform 12 is provided with a first support gap 13 and a second support gap 14, the root of the first magnetic suction false eyelash 51 and the root of the second magnetic suction false eyelash 52 can be respectively placed in the first support gap 13 and the second support gap 14. The gaps play a role of positioning and supporting, ensuring that the separated magnetic suction false eyelash 5 can be more stably fixed on the supporting platform 12 in the preset placement form, facilitating use and transportation.

In this embodiment, the first magnetic suction element 2 includes at least two magnetic suction columns 21 located within the magnetic protrusion 11. Specifically, upper and lower surfaces of the magnetic suction column 21 are respectively arranged adjacent to the first magnetic suction surface 111 and the second magnetic suction surface 112, and a length of the magnetic suction column 21 is less than a width between the first magnetic suction surface 111 and the second magnetic suction surface 112.

Further, three magnetic suction columns 21 are evenly disposed within the magnetic protrusion 11. An interval of the three magnetic suction columns 21 matches an interval of the three magnetic suction blocks 61. When the separated magnetic suction false eyelashes 5 are adsorbed on the supporting base 1, the three magnetic suction blocks 61 are respectively matched with the three magnetic suction columns 21. Through the above structure, due to the transverse arrangement of the magnetic suction column 21 within the magnetic suction protrusion 11, three magnetic suction points are formed by the three magnetic suction columns 21, which are matched with the three magnetic suction blocks 61 of the first magnetic suction false eyelash 51 and the second magnetic suction false eyelash 52 for magnetic suction. The placement of the three magnetic suction columns 21 is also set according to the arc of the magnetic suction protrusion 11, so that the separated false eyelashes adsorbed above are consistent with the chuck curvature of the eyelash clip 3, effectively playing the role of automatically and perfectly installing the separated false eyelashes on the eyelash clip 3, saving operation time.

In this embodiment, the eyelash clip 3 includes a first elastic clip arm 31 and a second elastic clip arm 32. The first elastic clip arm 31 is rotatably connected to the second elastic clip arm 32, and the first elastic clip arm 31 and the second elastic clip arm 32 are integrally formed. Among them, the first elastic clip arm 31 and the second elastic clip arm 32 are symmetrical clip arms of the same size.

Further, the second magnetic suction element 4 includes a first magnetic suction strip 41 and a second magnetic suction strip 42. The first elastic clip arm 31 is connected to a first chuck 311, and the first chuck 311 is attached to the first magnetic suction strip 41. The second elastic clip arm 32 is connected to a second chuck 322, and the second chuck 322 is attached to the second magnetic suction strip 42. The first chuck 311 and the second chuck 322 are arc-shaped and matched with the magnetic suction protrusion 11. Through the above structure, the first chuck 311 is magnetically connected to the magnetic suction block 61 on the first magnetic suction false eyelash 51 through the first magnetic suction strip 41, and the second chuck 322 is magnetically connected to the magnetic suction block 61 on the second magnetic suction false eyelash 52 through the second magnetic suction strip 42, effectively adsorbing the separated magnetic suction false eyelash firmly to the eyelash clip 3, preventing it from falling in the process of holding.

In this embodiment, an inner surface of the first elastic clip arm 31 is provided with a limiting groove 312 and an inner surface of the second elastic clip arm 32 is provided with a limiting column 322. When the first elastic clip arm 31 rotates to clamp the second elastic clip arm 32, the limiting column is fixed in the limiting groove. Through the above structure, when the eyelash clip 3 is pressed and clamped, the limiting column 322 and the limiting groove 312 are matched, so that the false eyelashes are less likely to be squeezed and damaged due to misplaced clamping or excessive force between the first clamping arm and the second clamping arm, improving the stability of the product.

One or more implementation modes are provided above in combination with specific contents, and it is not deemed that the specific implementation of the present invention is limited to these specifications. Any technical deductions or replacements approximate or similar to the method and structure of the present invention or made under the concept of the present invention shall fall within the scope of protection of the present invention.

What is claimed is:

1. A false eyelash tool kit comprises:

a separated magnetic adsorption false eyelash (5);

a supporting base (1) comprising a first magnetic suction element (2), the supporting base (1) configured to adsorb and support the separated magnetic adsorption false eyelash (5);

an eyelash clip (3) comprising a second magnetic suction element (4), the eyelash clip (3) configured to adsorb the separated magnetic adsorption false eyelash (5);

wherein when the separated magnetic adsorption false eyelash (5) is adsorbed on the supporting base (1), a first adsorption force is generated between the separated magnetic adsorption false eyelashes (5) and the supporting base (1);

when the separated magnetic adsorption false eyelash (5) is adsorbed onto the eyelash clip (3), a second adsorption force is generated between the separated magnetic adsorption false eyelashes (5) and the eyelash clip (3); the first adsorption force is less than the second adsorption force, the separated magnetic adsorption false eyelash (5) comprises a first magnetic suction false eyelash (51) and a second magnetic suction false eyelash (52), each of the first magnetic suction false eyelash (51) and the second magnetic suction false eyelash (52) are provided with a third magnetic suction element (6), wherein the supporting base (1) comprises a magnetic protrusion (11), and the first magnetic suction element (2) is located in the magnetic suction protrusion (11), the magnetic suction protrusion (11) comprises a first magnetic suction surface (111) and a second magnetic suction surface (112) opposite to the first magnetic suction surface (111), the first magnetic suction surface (111) is configured to adsorb the first magnetic suction false eyelash (51), and the second magnetic suction surface (112) is configured to adsorb the second magnetic suction false eyelash (52).

2. The false eyelash tool kit according to claim 1, wherein when the first magnetic suction false eyelash (51) is magnetically attached to the second magnetic suction false eyelash (52), the two third magnetic suction elements (6) are magnetically attracted and generate a third adsorption force.

3. The false eyelash tool kit according to claim 2, wherein the third adsorption force is greater than the second adsorption force.

4. The false eyelash tool kit according to claim 1, wherein the first magnetic suction false eyelash (51) comprises a first false eyelash body (511), a first fixing strip (512), and the third magnetic suction element (6), a root of the first false eyelash body (511) is connected and fixed to the first fixing strip (512), the third magnetic suction element (6) comprises a plurality of magnetic suction blocks (61), and at least two magnetic suction blocks (61) of the plurality of magnetic suction blocks (61) are arranged and fixed to the first fixing strip (512).

5. The false eyelash tool kit according to claim 4, wherein the second magnetic suction false eyelash (52) comprises a second false eyelash body (521), a second fixing strip (522), and the third magnetic suction piece (6), a root of the second false eyelash body (521) is connected and fixed to the second fixing strip (522), and at least two magnetic suction blocks (61) of the plurality of magnetic suction blocks (61) are arranged and fixed to the second fixing strip (522).

6. The false eyelash tool kit according to claim 5, wherein the first fixing strip (512) is evenly provided with three magnetic suction blocks (61) of the plurality of magnetic suction blocks (61), the three magnetic suction blocks (61) are disposed and fixed at two opposite ends and a middle portion of the first fixing strip (512).

7. The false eyelash tool kit according to claim 6, wherein the second fixing strip (522) is evenly provided with the three magnetic suction blocks (61), the three magnetic suction blocks (61) are disposed and fixed at two opposite ends and a middle portion of the second fixing strip (522).

8. The false eyelash tool kit according to claim 5, wherein the first fixing strip (512) and the second fixing strip (522) are transparent plastic strips.

9. The false eyelash tool kit according to claim 4, wherein each of the magnetic suction blocks (61) is a rectangular magnetic suction block (61).

10. The false eyelash tool kit according to claim 4, wherein the first magnetic suction element (2) comprises at least two magnetic suction columns (21) located within the magnetic protrusion (11).

11. The false eyelash tool kit according to claim 10, wherein upper and lower end surfaces of the magnetic suction column (21) are respectively arranged adjacent to the first magnetic suction surface (111) and the second magnetic suction surface (112), and a length of the magnetic suction column (21) is less than a width between the first magnetic suction surface (111) and the second magnetic suction surface (112).

12. The false eyelash tool kit according to claim 10, wherein three magnetic suction columns (21) are evenly disposed within the magnetic suction protrusion (11), an interval of the three magnetic suction columns (21) matches an interval of three magnetic suction blocks (61) of the magnetic suction blocks (61), when the separated magnetic suction false eyelashes (5) are adsorbed on the supporting base (1), the three magnetic suction blocks (61) are respectively matched with the three magnetic suction columns (21).

13. The false eyelash tool kit according to claim 1, wherein the supporting base (1) further comprises a supporting platform (12) with a supporting surface (121), the magnetic suction protrusion (11) is located above the supporting surface (121), and the supporting surface (121) is configured to support the first magnetic suction false eyelash (51) and the second magnetic suction false eyelash (52).

14. The false eyelash tool kit according to claim 13, wherein a first support gap (13) is provided at a connection part between the support surface (121) and the first magnetic suction surface (111), the first support gap (13) is configured to accommodate the first magnetic suction false eyelash (51), a second support gap (14) is disposed at a connection part between the support surface (121) and the second magnetic suction surface (112), and the second support gap (14) is configured to accommodate the second magnetic suction false eyelash (52).

15. The false eyelash tool kit according to claim 1, wherein the magnetic protrusion (11) is arc-shaped approximating a curvature of a eye.

16. The false eyelash tool kit according to claim 1, wherein the eyelash clip (3) comprises a first elastic clip arm (31) and a second elastic clip arm (32), the first elastic clip arm (31) is rotatably connected to the second elastic clip arm (32), and the first elastic clip arm (31) and the second elastic clip arm (32) are integrally formed.

17. The false eyelash tool kit according to claim 16, wherein the second magnetic suction element (4) comprises a first magnetic suction strip (41) and a second magnetic suction strip (42), the first elastic clip arm (31) is connected to a first chuck (311), the first chuck (311) is attached to the first magnetic suction strip (41), the second elastic clip arm (32) is connected to a second chuck (322), the second chuck (322) is attached to the second magnetic suction strip (42), and the first chuck (311) and the second chuck (322) are arc-shaped and matched with the magnetic protrusion (11).

18. The false eyelash tool kit according to claim 16, wherein an inner surface of the first elastic clip arm (31) is provided with a limiting groove (312), an inner surface of the second elastic clip arm (32) is provided with a limiting column (322), and when the first elastic clip arm (31) rotates to clamp the second elastic clip arm (32), the limiting column is fixed in the limiting groove.

* * * * *